US005497750A

United States Patent [19]

Mueller et al.

[11] Patent Number: 5,497,750

[45] Date of Patent: Mar. 12, 1996

[54] FUEL INJECTION DEVICE FOR INTERNAL COMBUSTION ENGINES

[75] Inventors: Peter Mueller, Hallein; Jaroslaw Hlousek, Golling, both of Austria

[73] Assignee: Robert Bosch GmbH, Stuttgart, Germany

[21] Appl. No.: 339,688

[22] Filed: Nov. 14, 1994

[30] Foreign Application Priority Data

Dec. 7, 1993 [DE] Germany ..... 43 41 543.1

[51] Int. Cl.[6] ..... F02M 7/00; F02M 41/00

[52] U.S. Cl. ..... 123/446; 123/467

[58] Field of Search ..... 123/446, 447, 123/456, 458, 467

[56] References Cited

U.S. PATENT DOCUMENTS

| | | | |
|---|---|---|---|
| Re. 33,270 | 7/1990 | Beck | 123/447 |
| 4,069,800 | 1/1978 | Kanda | 123/447 |
| 4,485,787 | 12/1984 | Kato | 123/446 |
| 4,601,269 | 7/1986 | Kato | 123/447 |
| 4,712,528 | 12/1987 | Schaffitz | 123/446 |
| 4,798,186 | 1/1989 | Ganser | 123/467 |
| 4,838,231 | 6/1989 | Ganser | 123/467 |
| 5,176,120 | 1/1993 | Takahashi | 123/446 |
| 5,191,867 | 3/1993 | Glassey | 123/447 |

FOREIGN PATENT DOCUMENTS

| | | | |
|---|---|---|---|
| 0041658 | 3/1984 | Japan | 123/446 |

*Primary Examiner*—Carl S. Miller
*Attorney, Agent, or Firm*—Edwin E. Greigg; Ronald E. Greigg

[57] ABSTRACT

A fuel injection device for internal combustion engines having a high pressure accumulation chamber, which can be filled by a high pressure fuel pump, from which chamber high pressure lines lead to the individual injection valves. Control valves for controlling the high pressure injection at the injection valves are formed in the individual high pressure lines. Additional pressure storage chambers are inserted in the individual high pressure lines as well, between these control valves and the high pressure accumulation chamber. In order to prevent the high system pressure from continually contacting the injection valves, the control valve is embodied so that during the injection pauses, it closes the communication between the injection valve and the pressure storage chamber and opens a communication between the injection valve and a relief chamber.

14 Claims, 1 Drawing Sheet

FUEL INJECTION DEVICE FOR INTERNAL COMBUSTION ENGINES

BACKGROUND OF THE INVENTION

The invention is based on a fuel injection device for internal combustion engines as defined hereinafter. German Offenlegungsschrift 37 00 687 discloses a fuel injection device of this kind in which a high pressure fuel pump supplies fuel from a low pressure chamber to a high pressure accumulation chamber, which communicates via high pressure lines with the individual injection valves, which protrude into the combustion chamber of the internal combustion engine to be fed; this common pressure storage system is maintained at a determined pressure by a pressure control device. To control the injection times and injection quantities at the injection valves, one electrically actuated control valve is inserted into each high pressure line of each injection valve; by its opening and closing, it controls the high pressure fuel injection at the injection valve.

An additional pressure storage chamber is provided in the known fuel injection device for each injection valve, which chamber is filled by the common pressure storage system and which is likewise connected to the injection valve next to the high pressure line leading from the high pressure accumulation chamber. By means of this division of the storage volume at each injection valve into two pressure chambers, which communicate with each other by means of a line of a determined length, the course of injection can be optimally adapted to the needs of each internal combustion engine, in connection with a throttled flow of fuel out of a pressure chamber, which acts upon the valve member of the injection valve; in particular, a slow pressure buildup can be achieved at the onset of injection and a higher pressure buildup can be achieved at the end of injection. The fuel quantity supplied to the injection valve directly from the common high pressure accumulation chamber is used merely as a means of controlling the reciprocating motion of the valve member of the injection valve, while the entire injection quantity is taken from whichever pressure storage chamber is smaller.

The known fuel injection device, though, has the disadvantage that because of the hydraulic communication between the pressure storage chamber and the pressure chamber at the injection valve member, the high system pressure constantly impinges on the injection valve member, thus putting a high mechanical load on the injection valve.

Furthermore, the control of the injection process is produced by means of the hydraulic blocking or relieving of a pressure chamber at the valve member of the injection valve by the pressure fluctuations of the fuel in the pressure storage system. The control events at the individual injection valves can mutually affect one another via the high pressure lines which connect them, which leads to imprecisions. Furthermore, the disposition of two high pressure lines per injection valve and the attendant pressure connections increases the cost, so the known fuel injection device does not meet the current strong demand for a structurally simple design, higher injection precision over a long service life, and high operational reliability.

OBJECT AND SUMMARY OF THE INVENTION

The fuel injection device according to the invention has the advantage over the prior art that the injection valve is disconnected from the pressure system during the injection pauses by the control valve, so that the high system pressure is not in continuous contact with the injection valve. Apart from a reduced mechanical loading of the injection valve, this also means that the valve member of the injection valve is closed and can be held in the closed position by its valve spring, which makes a high pressure impingement on the valve member in the closing direction unnecessary, and consequently contributes to a simplification of the entire injection device. This is achieved advantageously by means of an electrically triggered control valve, which is embodied as a double seat valve, whose stroke stop, i.e. reciprocation stop, on each end is constituted by means of a valve seat, and which is pressure balanced in the open and closed positions by means of the identically dimensioned pressure engagement faces on the valve member in both stroke directions, i.e directions of reciprocation, so that the adjusting forces of the magnet valve, which actuates the valve member, merely have to overcome the tension of a restoring spring.

A further advantage is achieved by means of the through bore in the pistonlike valve member of the control valve, via which during the injection pauses, the fuel that is at high pressure flows out of the high pressure region inside the control valve and into a relief chamber, and via which a constant pressure balancing takes place on both face ends of the valve member, or in the chambers which adjoin the member.

In order to achieve a course of injection pressure having a slight pressure buildup at the beginning and a high injection pressure toward the end, the volume of the pressure storage chambers associated with the injection valves is embodied as 5 to 20 times greater than the maximal injection quantity at the injection valve; the fuel pressure in the pressure storage chamber reflected at the beginning of the injection at the injection valve is used for a pressure increase to a value above that of the system pressure. This superelevation of the pressure can be adapted via the replenishing flow, which can be adjusted by means of the dimensioning of the high pressure line and by a pressure valve in the inlet in such a way that the highest fuel pressure in the system is built up toward the end of injection. A flow throttle inserted in the pressure connection of the pressure storage chamber avoids a propagation of the pressure fluctuations in the system.

The invention will be better understood and further objects and advantages thereof will become more apparent from the ensuing detailed description of a preferred embodiment taken in conjunction with the drawings.

DESCRIPTION OF THE PREFERRED EMBODIMENT

Figure 1:
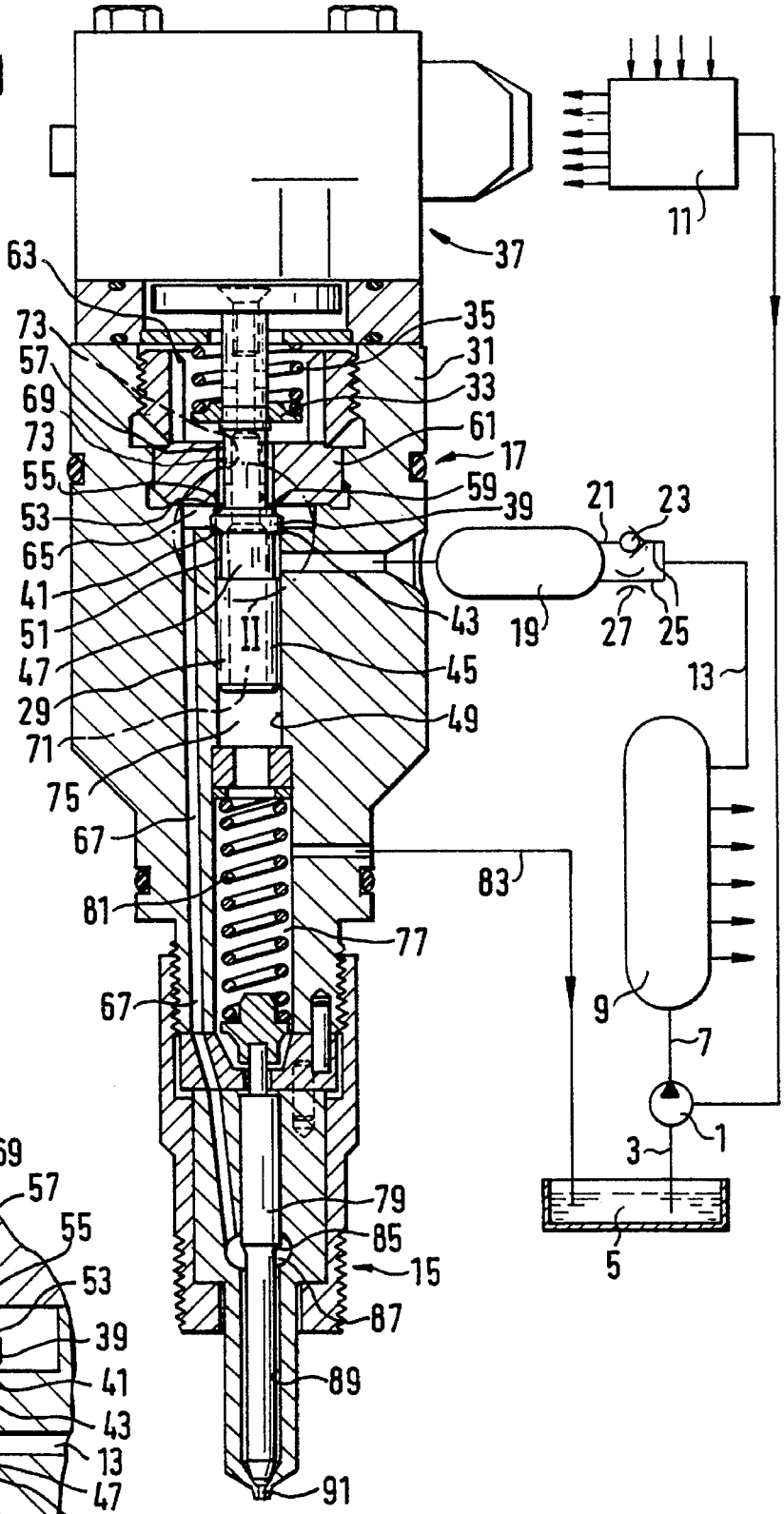
FIG. 1 shows a schematic representation of the fuel injection device with a longitudinal section through the control valve and the injection valve.

In the fuel injection device shown in FIG. 1, a high pressure fuel pump 1 communicates on the suction side via a fuel supply line 3 with a low pressure chamber 5, which is filled with fuel, and communicates on the pressure side via a supply line 7 with a high pressure accumulation chamber 9; the feed quantity of the high pressure fuel pump 1 can be controlled by an electric control device 11.

High pressure lines 13 lead from the high pressure accumulation chamber 9 to the individual injection valves 15, which protrude into the combustion chamber of the internal combustion engine to be fed; to control the injection event, an electric control valve 17 is inserted at each injection valve 15 in the respective high pressure line 13.

Furthermore, an additional pressure storage chamber 19 is provided in each high pressure line 13 between the high pressure accumulation chamber 9 and the control valve 17; the volume of this storage chamber is roughly 5 to 20 times greater than the maximal injection quantity at the injection valve 15 per injection event, and it communicates via two parallel pressure connections with the part of the high pressure line 13 that leads to the high pressure accumulation chamber 9. A first pressure connection 21 has a pressure valve 23, which is embodied as a check valve and which opens in the direction of the pressure storage chamber 19, and a second pressure connection 25 has a throttle restriction 27; an uncontrolled return flow of fuel into the part of the high pressure line 13 which leads to the high pressure accumulation chamber 9 should be avoided via the throttle 27, as should an influence of the pressure in the pressure storage chambers of the remaining injection valves, while the pressure valve 23 makes possible a rapid replenishment of the pressure storage chamber 19. The supply and draining quantities in the pressure storage chamber 19 can be set via the layout of the throttle 27 and of the pressure valve 23, depending on the dimensioning of the high pressure line 13, particularly during the high pressure injection; the throttle 27 and pressure valve 23 can also be disposed switched in series in a common pressure connection.

Figure 2:
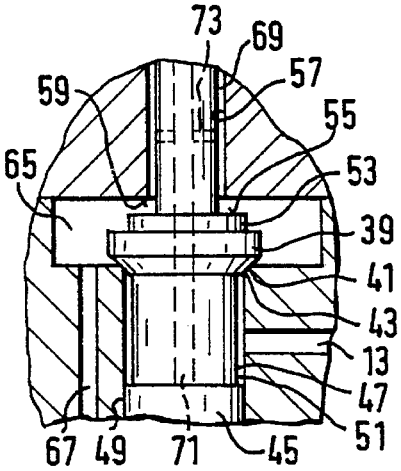
FIG. 2 shows the embodiment of the valve seat and sealing faces of the control valve in an enlarged detail from FIG. 1.

The control valve 17 is embodied as a 3/2-way valve, whose pistonlike valve member 29 is actuated by an electric adjusting magnet 37, which on its one face end acts in opposition to a compression spring 35, which is supported on the valve member 29 between the housing 31 and a spring plate 33; the electrical power supply to this adjusting magnet 37 is controlled by the control device 11. On its shank, the valve member 29 has an annular rib 39, whose lower transition face to the piston shank, which face is remote from the adjusting magnet 37, is embodied as conical and constitutes a first conical sealing face 41 on the valve member 29, which cooperates with a conical valve seat 43. This conical valve seat 43, shown in the enlargement in FIG. 2, is embodied by means of a conical diametrical widening of a guide bore 49 inside the housing 31 of the control valve 17, which bore contains a guide piston part 45 on the valve member 29. An annular groove 49 is provided on the valve member 29 between the conical valve sealing face 41 and the guide piston part 45, which defines the valve member 29 on the side remote from the adjusting magnet 37, which annular groove 49, along with the wall of the guide bore 49, forms a pressure chamber 51, which is defined by the guide piston part 45 and the conical valve sealing face 41 on the annular rib 39 and into which a part of the high pressure line 13 feeds. The high pressure line 13 leads from the pressure storage chamber 19 to the control valve 17 in such a way that the discharge point cannot be closed by means of the valve member 29 during its reciprocating motion.

The transition toward the adjusting magnet 37 from the annular rib 39 to the piston shank is effected via an annular step 53; the resultant axially oriented annular face on the annular step 53 forms a second flat sealing face 55, which cooperates with a flat valve seat 59, which encompasses a bore 57, on the axial face end of an intermediate piece 61; the piston shank continues on through the bore 57 to the adjusting magnet 37 and protrudes with its end into a spring chamber 63, which contains the compression spring 35 of the valve member 29.

The outer diameter of the annular step 53 on the annular rib 39, which step carries the flat, axial sealing face 55 is identical to the diameter of the guide piston part 45 to achieve a pressure balancing at the open control valve 17.

The reciprocating motion of the valve member 29 is defined by means of contact with each of the sealing faces 41, 55 on one of the valve seats 43, 59. The annular rib 39 is disposed in an annular chamber which constitutes an antechamber 65, which is defined by the respective valve seats 43, 59. A relief conduit 69 and a pressure line 67 to the injection valve 15 lead from this antechamber 65. This relief conduit 69 is constituted in part by an annular gap remaining between the piston shank and the bore 57 in the intermediate piece 61, which conduit 69 is embodied as having an outer diameter smaller than the sealing face 55 and thus can be closed by it. The bore 57 feeds into the spring chamber 63, which contains the compression spring 35 of the valve member 29, which spring functions as a restoring spring; the bore 57 communicates via cross bores 73, which intersect an axial through bore 71 in the valve member 29, with a relief chamber 75, which is defined by the face end of the guide piston 45 of the valve member 29 remote from the adjusting magnet 37. This relief chamber 75, which is formed inside the guide bore 49 continues axially in a direction remote from the adjusting magnet 37 into a spring chamber 77 of the injection valve 15, in which a valve spring 81, which impinges on a valve member 79 of the injection valve 15 in the closing direction, and from which a return line 83 leads into the low pressure chamber 5.

The valve member 79 of the injection valve 15 is provided in a known manner with a conical pressure shoulder 85, which protrudes into a pressure chamber 87 connected to the pressure line 67 in such a way that the pressure in the pressure chamber 87 impinges on the valve member 79 in the opening direction. Furthermore, an injection conduit 89 leads from the pressure chamber 87 along the valve member 79 to one or more injection openings 91 of the injection valve 15, which are controlled by the sealing face on the tip of the valve member 79, and into the combustion chamber, not shown, of the internal combustion engine to be fed.

The fuel injection device works in the following manner.

The high pressure fuel pump 1 supplies the fuel from the low pressure chamber 5 into the high pressure accumulation chamber 9 and thus builds up a high fuel pressure in it, which can be adjusted via the control of the high pressure pump 1. This high fuel pressure continues via the high pressure lines 13 into the pressure chamber 51 of the individual control valves 17 at the injection valves 15 and also fills the respective pressure storage chambers 19 via the pressure valves 23.

At rest, or when the injection valve 15 is closed, the adjusting magnet 37 at the control valve 17 is switched off so that the compression spring 35 holds the valve member 29 via the spring plate 33 with the conical sealing face 41 contacting the conical valve seat 43, so that the communication is closed between the pressure chamber 51, which is under high pressure, and the antechamber 65, which is permanently connected via the pressure line 67 to the injection valve 15, and the communication is opened from the antechamber 65 to the relief conduit 69.

When an injection takes place at the injection valve 15, the adjusting magnet 37 is supplied with current and moves the valve member 29 of the control valve 17 against the restoring force of the spring 35 until its flat valve sealing face 55 contacts the flat valve seat 59. The communication of the antechamber 65 is shut off from the relief conduit 69 and opened up to the pressure line 67 so that the high fuel pressure now extends from the pressure chamber 51 via the antechamber 65 and the pressure line 67 to the pressure chamber 87 of the injection valve 15 and the injection at the injection openings 91 takes place in a known manner via the lifting of the valve member 79 from its valve seat.

A superelevation of pressure over the system pressure can be achieved in the pressure line 67 during the injection phase in the following manner. By means of the movement of the valve member 29, the pressure chamber 51 communicates with the antechamber 65, and a flow ensues in the direction of the cross bore 73 and the through bore 71 to the unpressurized return line 83. This flow, as a consequence, produces a flow in the line connection from the pressure storage chamber 19 to the pressure chamber 51 and in the line 13 between pressure storage chamber 19 and high pressure accumulation chamber 9.

At the end of the opening stroke of the valve member 29, the fuel flow is diverted toward the pressure line 67 by the contact of the sealing face 55 with the valve seat 59. A superelevation of pressure is produced by means of the dynamic pressure effect of the fuel flow in motion. This superelevation of pressure can be affected by means of the suitable choice of the variables involved, such as line length, line diameter, storage volume, throttle cross section, etc.

Furthermore, due to the conversion of the flow energy, a pressure increase of the injection pressure can exceed the value of the system pressure, by the fuel pressure wave going to the injection valve being partially reflected at the injection valve, returning to the pressure storage chamber 19 and leading to a superelevation of pressure in it, which can be adjusted by means of the flow energy of the replenishing flow of fuel from the high pressure accumulation chamber 9 and by means of the dimensioning of the throttle 27, which prevents a rapid pressure decrease. This increased fuel pressure extends once again to the injection valve 15 and increases its injection rate toward the end of injection. The course of injection at the injection valve 15 can be furthermore shaped via the opening cross section at the valve member 29 (diameter/stroke), the volume of the antechamber 65 and of the pressure line 67, as well as the volume of the pressure storage chamber 19.

When the injection comes to an end, the adjusting magnet 37 is switched off again and the compression spring 35 brings the valve member 29 into contact again with the conical valve seat 43; the valve member 29 is also pressure balanced in the open state by the annular step 53. The opening cross section at the flat valve seat 59 is opened and the fuel which is under high pressure is released via the relief conduit 69, the spring chamber 63, the cross and longitudinal bores 73, 71 in the valve member 29, into the relief chamber 75, from which the fuel flows away via the spring chamber 77 and the return line 83 into the low pressure chamber 5 so that the valve member 79 of the injection valve 15, relieved of pressure, goes to the closed position influenced by the valve spring 81, and is once more pressure balanced. The cross section of the relief conduit 69 is designed so that on one side, it guarantees a rapid pressure drop in the pressure line 67 to below the closing pressure of the injection valve 15, but on the other side throttles the flow out of the pressure line 67 so that a residual pressure remains in the pressure line 67 and the injection valve 15 during the injection pauses.

In order to prevent a mutual influence of the individual injection valves 15 on each other by means of the pressure wave returning from the closed control valve 17 at the end of injection, the volume of the pressure storage chamber 19 and the cross section of the throttle 27 in the pressure connection 25, which serves as a return line, should be adapted to one another in such a way that the pressure peaks inside the pressure storage chamber 19 and to the high pressure accumulation chamber 9 are reduced.

The foregoing relates to a preferred exemplary embodiment of the invention, it being understood that other variants and embodiments thereof are possible within the spirit and scope of the invention, the latter being defined by the appended claims.

What is claimed and desired to be secured by Letters Patent of the United States is:

1. A fuel injection system for internal combustion engines having a high pressure fuel pump (1), which supplies fuel from a low pressure chamber (5) into a high pressure accumulation chamber (9), which communicates via high pressure lines (13) with injection valves (15), each of which include a housing, said injection valves protrude into the combustion chamber of the engine to be fed and whose opening and closing motion is controlled by an electrically triggered control valve (17) in said housing disposed in the high pressure line (13) at each injection valve (15), said control valve (17) has a piston-like valve member (29) with an annular rib (39) which includes transition faces, said transition faces are each embodied as valve sealing faces (41, 45), each of which cooperate with a respective valve seat (43, 59) structurally formed on said housing, said system includes an additional pressure storage chamber (19) at each injection valve (15), which is integrated into the high pressure line (13) between the high pressure accumulation chamber (9) and the injection valve (15), during pauses between injections, the control valve (17) at the injection valve (15) closes a communication between the additional pressure storage chamber (19) and a pressure chamber (87) inside the injection valve (15), which chamber (87) acts upon the valve member (79) of the injection valve (15) in the opening direction, and said control valve (17) opens up a communication between the pressure chamber (87) of the injection valve (15) and a relief chamber (75).

2. The fuel injection device according to claim 1, in which said pistonlike valve member (29) includes a shank which is narrower in diameter than said annular rib (39), and said annular rib (39) includes a first transition face which faces the valve member shank which is embodied as conical and constitutes a first valve sealing face (41), which cooperates with a conical valve seat (43) on said housing, and said conical rib includes a second transition to the valve member shank which takes place via an annular step (53), whose axial, annular face end remote from the annular rib (39) constitutes a second, flat valve sealing face (55), which cooperates with a flat valve seat (59) formed on the housing.

3. The fuel injection device according to claim 2, in which a reciprocating motion of the valve member (29) of the control valve (17) is defined by a contact of each of the valve sealing faces (41, 55) on one of the valve seats (43, 59).

4. The fuel injection device according to claim 2, in which an outer diameter of the annular step (53), which carries the flat valve sealing face (55) is the same size as a diameter of a guide piston (45) of the valve member (29) in a guide bore (49), which piston (45) adjoins an annular groove (47) leading from the conical valve sealing face (41) and defines a second pressure chamber (51) between a wall of the guide bore (49) and a wall of the valve member (29) in a region of the annular groove (47).

5. The fuel injection device according to claim 4, in which the annular rib (39) is disposed in an antechamber (65) which is permanently connected with a pressure line (67) leading to the pressure chamber (87) of the injection valve (15).

6. The fuel injection device according to claim 5, in which the pressure chamber (51) in the region of the annular groove (47) of the valve member (29) is permanently connected to a section of the pressure line (67) that leads from the pressure storage chamber (19).

7. The fuel injection device according to claim 5, in which the communication can be closed off between the antechamber (65) and the pressure chamber (51) by contact of the conical sealing face (41) of the valve member (29) against the conical valve seat (43).

8. The fuel injection device according to claim 6, in which the communication can be closed off between the antechamber (65) and the pressure chamber (51) by contact of the conical sealing face (41) of the valve member (29) against the conical valve seat (43).

9. The fuel injection device according to claim 5, in which a relief conduit (69) is formed by means of the embodiment of the valve member shank, which adjoins the flat valve sealing face (55), as having a smaller diameter than a bore (57) which receives said shank, which relief conduit (69) connects the antechamber (65) to the relief chamber (75) when the flat seat valve is open.

10. The fuel injection device according to claim 9, in which the pistonlike valve member (29) of the control valve (17) has an axial through bore (71) and cross bores (73) radiating out from the valve member in the region of the relief conduit (69); the fuel passage from the relief conduit (69) into the relief chamber (75) of the fuel flowing out of the pressure line (67) and the antechamber (65) takes place via these cross bores (73) when the flat seat valve is open.

11. The fuel injection device according to claim 1, in which the control valve (17) is embodied as a 3/2-way magnet valve, which is triggered by means of an electric control device (11).

12. The fuel injection device according to claim 1, in which the storage volume of the pressure storage chamber (19) is roughly 5 to 20 times greater than the maximal injection quantity at the injection valve (15).

13. The fuel injection device according to claim 1, in which the pressure storage chamber (19) communicates via two parallel pressure connections with the section of the high pressure line (13) leading to the high pressure accumulation chamber (9), of which a first pressure connection (21) has a pressure valve (23) which opens in a direction of the pressure storage chamber (19), and a second pressure connection (25) which has a throttle reduction (27).

14. The fuel injection device according to claim 1, in which the pressure storage chamber (19) communicates via a pressure connection with the section of the high pressure line (13) leading to the high pressure accumulation chamber (9), which section has a pressure valve which opens toward the pressure storage chamber (19), and has a throttle reduction connected in series with the pressure valve.

* * * * *